US005718426A

United States Patent [19]

Youn

[11] Patent Number: 5,718,426

[45] Date of Patent: Feb. 17, 1998

[54] SHEET FEEDING APPARATUS AND METHOD THEREOF

[75] Inventor: Ki-Cho Youn, Kyungki, Rep. of Korea

[73] Assignee: LG Electronics Inc., Rep. of Korea

[21] Appl. No.: 535,358

[22] Filed: Sep. 28, 1995

[30] Foreign Application Priority Data

Sep. 28, 1994 [KR] Rep. of Korea ..... 24574/1994

[51] Int. Cl.[6] ..... B65H 5/00

[52] U.S. Cl. ..... 271/225; 271/176; 271/184; 271/902

[58] Field of Search ..... 271/3.14, 3.16, 271/3.17, 3.19, 3.2, 225, 258.01, 265.01, 265.02, 266, 272, 303, 902, 184, 176; 194/206, 207; 902/14, 15, 17

[56] References Cited

U.S. PATENT DOCUMENTS 4,318,484 3/1982 Stiernspetz ..... 271/225 X

*Primary Examiner*—David H. Bollinger

*Attorney, Agent, or Firm*—Ostrolenk, Faber, Gerb & Soffen, LLP

[57] ABSTRACT

An improved sheet feeding apparatus and a method thereof, which includes a driving unit for driving corresponding elements; a sheet feeding unit for feeding a sheet by the driving unit; a sheet withdrawing detection unit for detecting as to whether or not a sheet is withdrawn; a sheet feeding direction converting unit for converting a feeding-back direction of the sheet; a sheet feeding-back completion detecting unit for detecting the completion of feeding-back sheet; and a sheet storing unit for storing a sheet into a sheet storing box, and further includes the steps of a first step which judges as to whether or not a sheet is fed back; a second step which converts a sheet feeding direction; a third step which feeds back the sheet; a fourth step which judges as to whether or not a sheet feeding-back is completed; and a fifth step which stores a sheet into a sheet storing box, thus advantageously preventing jamming and skewing of a sheet in operation.

13 Claims, 7 Drawing Sheets

SHEET FEEDING APPARATUS AND METHOD THEREOF

BACKGROUND OF THE INVENTION

1. Field of the Invention

The present invention relates to a sheet feeding apparatus and a method thereof, and in particular to an improved sheet feeding apparatus and a method thereof capable of advantageously preventing jamming and skewing of a sheet by providing a more stable feeding-back system of a sheet, thus preventing malfunction of the machine.

2. Description of the Conventional Art

Conventionally, sheet feeding apparatus has been used in a cash dispenser in bank or the like for offering convenient service to user.

The construction of a conventional sheet feeding apparatus will now be explained with reference to FIG. 1.

To begin with, a sheet feeding apparatus includes feeding belts 5 and 6 connected to spaced-apart upper feeding rollers 1 and 2 and lower feeding rollers 3 and 4, respectively, for feeding a sheet therebetween. A feeding direction convertor 7 is disposed behind the feeding roller 4. In addition, a sheet storing box 8 is disposed below the feeding belt 6 for storing the sheets which are withdrawn.

The upper and lower feeding rollers 1 and 2 are rotated in a clockwise direction and the lower feeding rollers 3 and 4 are rotated in a counterclockwise direction by a motor (not shown). Thereafter, the sheet between the feeding belts 5 and 6 is fed to the outside of the cash dispenser. When the sheet arrives at an outlet (not shown), the upper feeding rollers 1 and 2 and the lower feeding rollers 3 and 4 stop, and a user takes out the sheet. At this time, if the user does not take out the sheet for a predetermined time, each of the upper feeding rollers 1 and 2 and the lower feeding rollers 3 and 4 rotate in a reverse rotation direction, so that the sheet is fed back toward the inside of the cash dispenser for storing the sheet into the sheet storing box 8.

However, the conventional sheet feeding apparatus and method thereof have disadvantages in that when a sheet is fed back in, the sheet can be damaged by jamming skewing which may be caused by a gap formed between the feeding belts.

SUMMARY OF THE INVENTION

Accordingly, it is an object of the present invention to provide a sheet feeding apparatus and a method thereof, which overcome the problems encountered in the conventional sheet feeding apparatus and a method thereof.

It is another object of the present invention to provide an improved sheet feeding apparatus and a method thereof.

To achieve the above objects, there is provided a sheet feeding apparatus, which includes a driving unit for providing driving force; a sheet feeding unit for feeding a sheet forwardly toward a withdrawing port and feeding back a sheet rearwardly away from the withdrawing port toward a sheet storing box, the sheet feeding unit being driven by said driving unit; a sheet withdrawing detection unit for detecting whether a sheet fed forwardly by the sheet feeding unit has been withdrawn from the withdrawing port; a sheet feeding direction converting unit disposed between the front guide rollers and rear guide rollers and movable between a first position and a second position for converting a feeding direction of a sheet being fed back; a sheet feeding-back completion detecting unit for detecting the completion of guiding the sheet into the sheet storing box; and a sheet storing means for storing a feeding-back sheet into a sheet storing box.

To achieve the above objects, there is also provided a sheet feeding method, which includes a first step which judges whether or not a sheet is fed back; a second step which converts a sheet feeding direction; a third step which feeds back the sheet; a fourth step which judges as to whether or not a sheet feeding-back is completed; and a fifth step which stores a sheet into a sheet storing box.

DETAILED DESCRIPTION OF THE INVENTION

Figure 1:
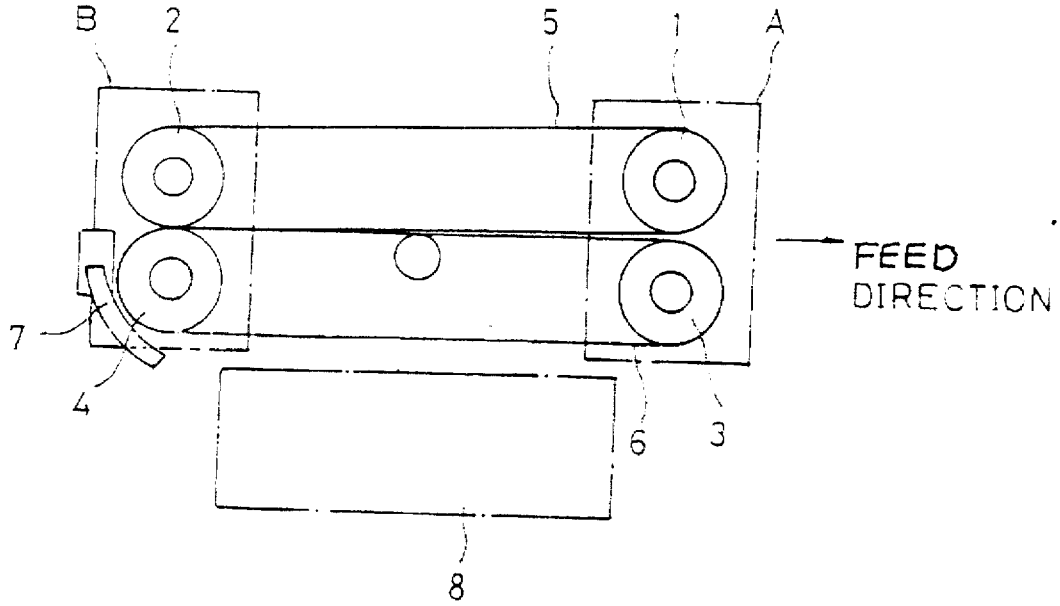
FIG. 1 CONVENTIONAL ART
FIG. 1 is a side view of a conventional sheet feeding apparatus.

The construction of the sheet feeding apparatus according to the present invention will now be explained with reference to FIGS. 2 through 8B. In the drawings, reference numerals 11 and 12 denote spaced-apart brackets, 13 and 14 denote spaced-apart upper and lower sheet guides, and 15 denotes a sheet storing box.

To begin with, the sheet feeding apparatus includes a step motor 21 for providing a predetermined rotation force to corresponding elements, a sheet feeding unit for forwardly or backwardly feeding the sheet by receiving the driving force from the step motor 21, a sheet feed-back detection unit for detecting as to whether or not a sheet is fed-back, a sheet feeding direction converting unit for converting the feeding direction of the sheet when the sheet is fed back, a sheet feeding-back completion detection unit for detecting as to whether the feeding-back of the sheet is completed, a sheet storing unit for storing the sheets when they are returned from the withdrawing port, and a sheet guiding unit for stably guiding the sheet during a withdrawing.

The sheet feeding unit includes spaced-apart rotary shafts 22, 23, and 24 each rotatably disposed at brackets 11 and 12, feeding rollers 25, 26 and 27 fixed to the both sides of the intermediate portion of the rotary shafts 22, 23, and 24, a following pulley 28 and a driving pulley 29 each engaged to one end of the rotary shafts 22 and 23, a belt 30 for connecting the following pulley 28 and the driving pulley 29, connecting pulleys 31 and 32 each fixed to the other end of the rotary shafts 23 and 24, and a belt 33 for connecting the connecting pulleys 31 and 32.

The step motor 21 is drivingly connected to a motor gear 34, an idler gear 35, and a connecting gear 36 fixed to an intermediate rotary shaft 23, respectively.

The sheet withdrawing detection unit includes withdrawing detection sensors 37 and 38 each fixed to the upper and lower portions of one end of upper and lower sheet guides 13 and 14.

The sheet feeding direction converting unit includes a central shaft 39 rotatably disposed in a predetermined portion of the brackets 11 and 12, spaced-apart direction converting member 40 disposed at the intermediate portion of the central shaft 39, and a solenoid 41 for rotating the central shaft in a predetermined direction.

That is, the solenoid 41 is fixed to a fixing plate 42 fixed to the bracket 12. A link 43 is linked to a plunger 41*a* of the solenoid 41. A link 45 is linked to the end of the central shaft 39. The links 43 and 45 are linked to each other by a pin 46, thus both are eccentric about the central axis of the central shaft 39. A tension spring 47 is connected to the connecting pin 44 and the fixing portion 42*a* of the fixing plate 42. 42*b* denotes a plunger stopper for stopping the plunger. In a state that electric power is applied to the solenoid 41, the plunger 41 is held inwardly with a force greater than the elastic force of the tension spring 47 and is received within the solenoid 41, thus permitting the central shaft 39 to rotate in a counterclockwise direction and stopping the sheet from moving forwardly by the direction converting member 40 and guiding the sheet into the sheet storing box 15.

The direction converting member 40 is protruded upwardly from the upper sheet guide 13 through a plurality of holes 13*a* formed on the upper sheet guide 13.

The sheet feed-back completion detection unit includes sheet withdrawing sensors 48 and 49 disposed at a predetermined portion of the upper sheet guides 13 and 14 corresponding to the front portion of the sheet feeding direction converting unit: that is, to the intermediate portion of the upper sheet guides 13 and 14.

The sheet storing unit includes a central shaft 50 rotatably disposed at a predetermined portion of the brackets 11 and 12, a pushing plate 51 fixed to the intermediate portion of the central shaft 39, and a solenoid 52 for rotating the central shaft 50 in a predetermined direction.

That is, the solenoid 52 is fixed to the fixing plate 53 fixed to the bracket 12. A link 54 is linked to the plunger 52*a* of the solenoid 52 by a connecting pin 55. A link 56 is linked to an end of the central shaft 50. The link 54 and the link 56 are linked to each other by the connecting pin 57, thus both are eccentric about a central axis of the central shaft 50. A tension spring 58 is inserted on the plunger 52*a*. In a state that electric power is applied to the solenoid 52, the plunger 52*a* is drawn in by a force beyond the elastic force of the tension spring 58, and the plunger 52*a* is received in the solenoid 52, permitting the central shaft 50 to rotate in a clockwise direction, whereby the sheet is guided as the pushing plate 51 is lowered.

In addition, the sheet guiding unit includes a fixing plate 59 fixed to a predetermined portion of the brackets 11 and 12, supporting shafts 60 and 61 each fixed to the both ends of the fixing plate 59, and idler rollers 62 and 63 rotatably engaged with the both ends of the supporting shafts 60 and 61 and coming into contact with the feeding rollers 25 and 26.

Meanwhile, the following pulley 28 is engaged to the rotary shaft 22 to be rotatable with a predetermined fraction force. In case that the sheet is forwardly/backwardly fed by the driving force of the step motor 21, the driving force of the step motor 21 is directly transferred to the following pulley 28 via the belt 30, permitting the rotary shaft 22 to rotate. In addition, in case that a user takes out a sheet which is located between the feeding roller 25 and the idler roller 62, the following pulley 28 maintains an original state, and the idler roller 62 rotates the rotary shaft 22 through the feeding roller 25, whereby a more stable withdrawing operation of the sheet can be achieved.

Figure 2:
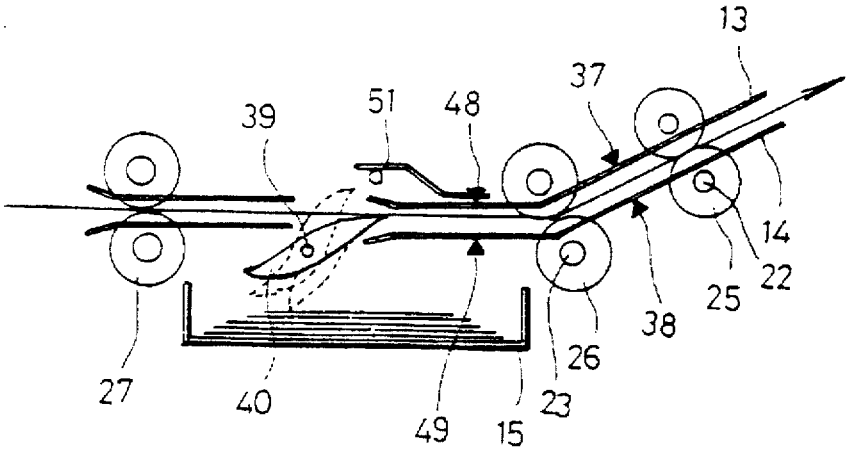
FIG. 2 is a schematic side view of a sheet feeding apparatus according to the present invention.
Figure 3:
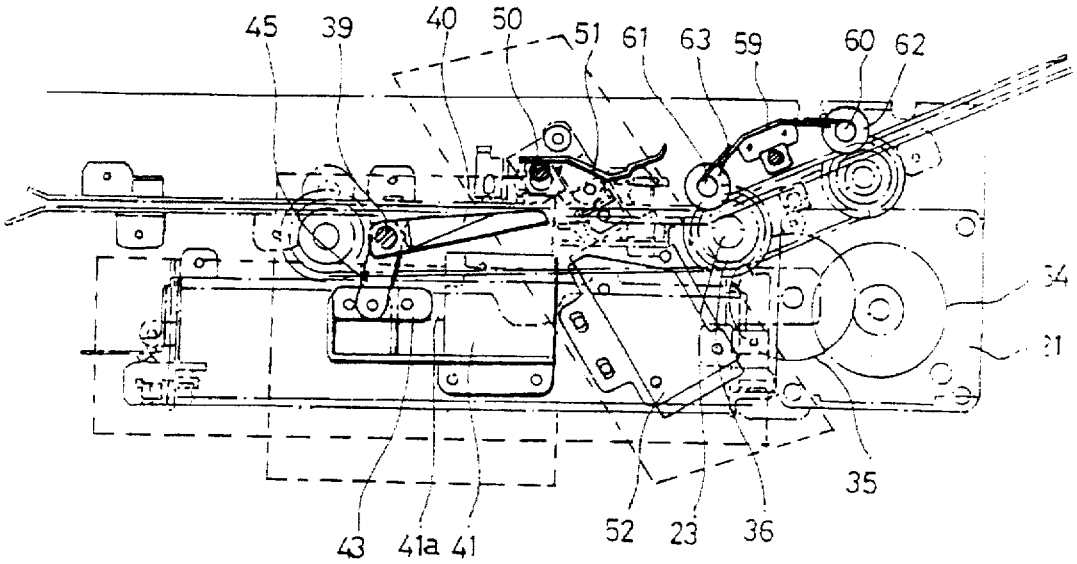
FIG. 3 is a side view of a sheet feeding apparatus according to the present invention.

The automatic sheet withdrawing method will now be explained with reference to FIG. 2.

To begin with, the sheet automatic withdrawing method includes a first step which judges whether or not a sheet is withdrawn, a second step which converts the transmission direction of the sheet, a third step which feeds back the sheet, a fourth step which judges as to whether or not a sheet feeding-back is completed, and a fifth step which stores the sheet in the sheet storing box.

The operation of a sheet feeding apparatus and method according to the present invention will now be explained.

Figure 4:
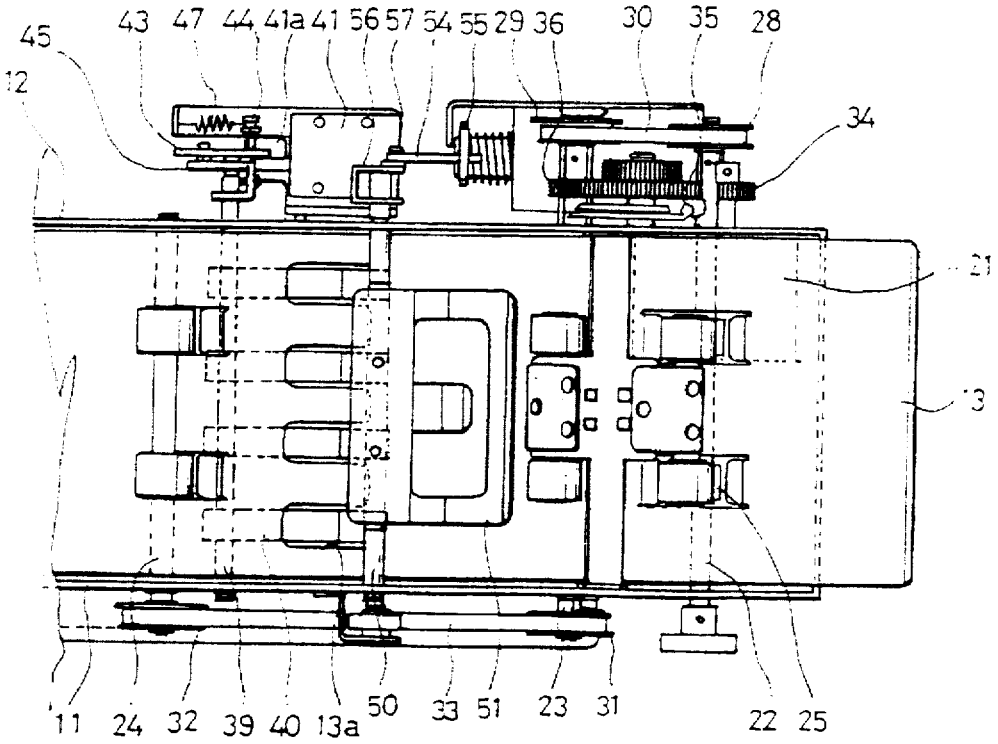
FIG. 4 is a top view of a sheet feeding apparatus according to the present invention.
Figure 5:
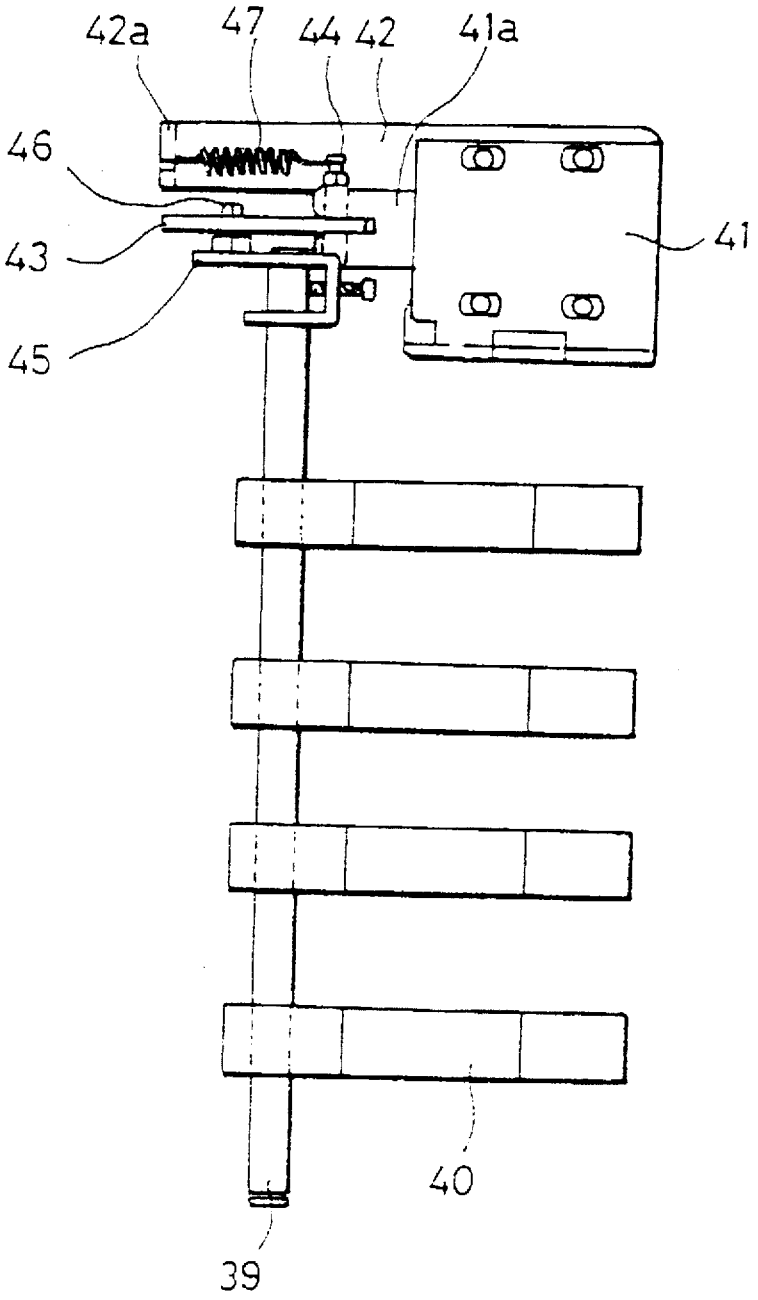
FIG. 5 is a top view of a sheet feeding direction converting unit of a sheet feeding apparatus according to the present invention.
Figure 6A:
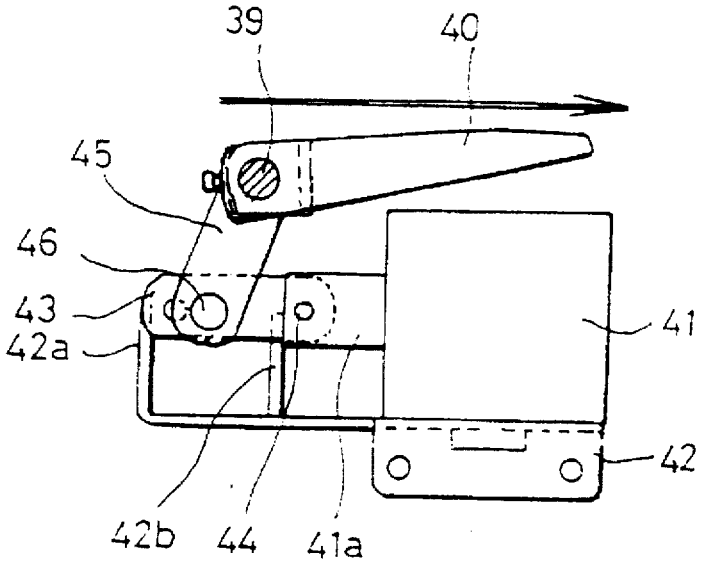
FIGS. 6A and 6B are side views of a sheet feeding direction converting unit for explaining an operation thereof according to the present invention.
Figure 6B:
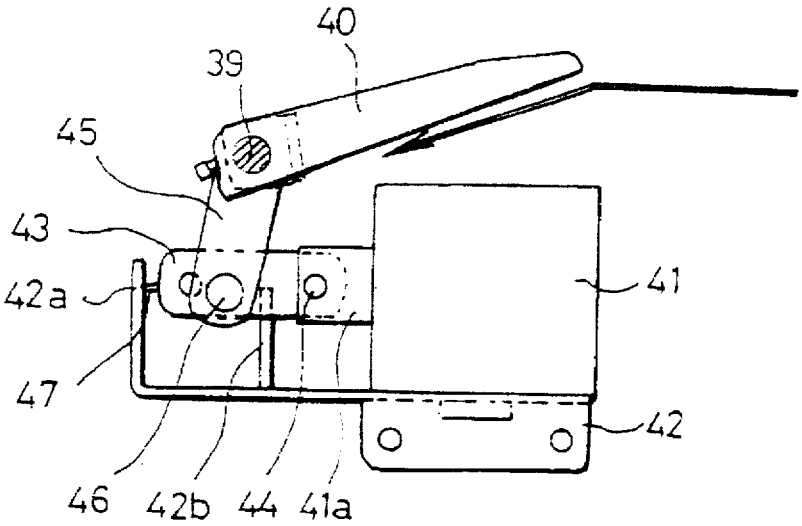
Figure 7:
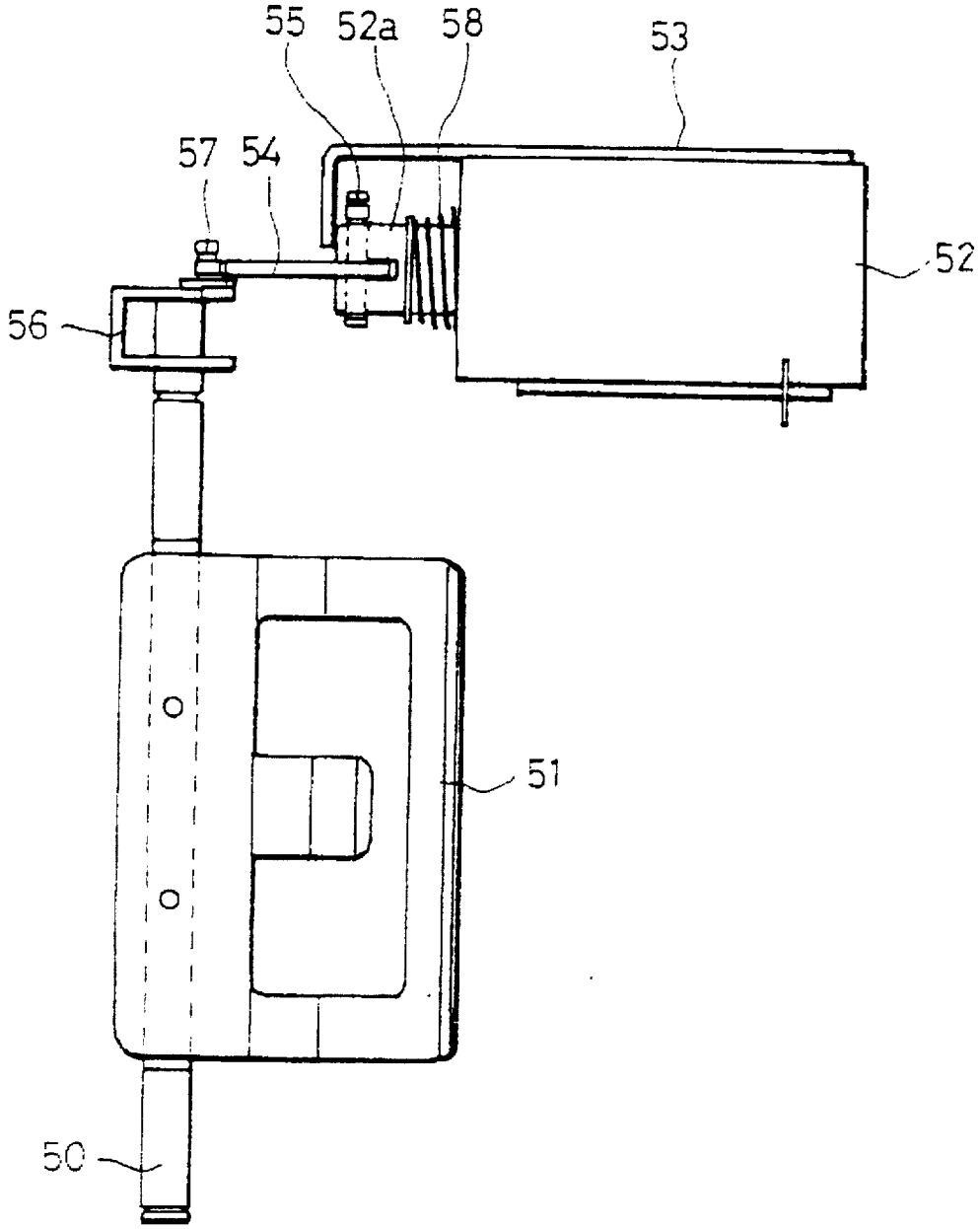
FIG. 7 is a top view of a sheet guiding unit of a sheet feeding apparatus according to the present invention.
Figure 8A:
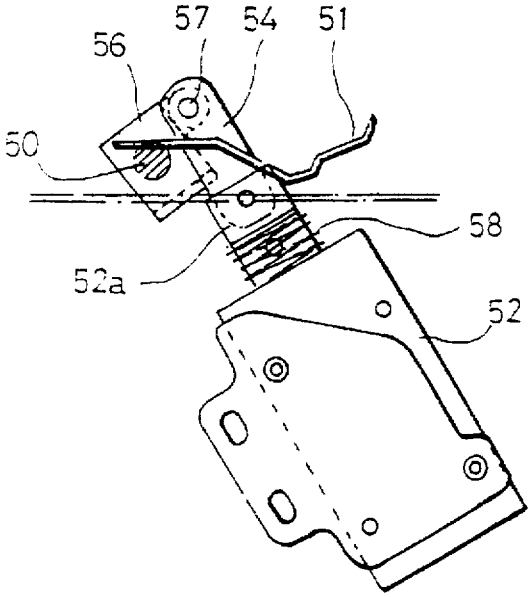
FIGS. 8A and 8B are side views of a sheet guiding unit of a sheet feeding apparatus for explaining an operation thereof according to the present invention.
Figure 8B:
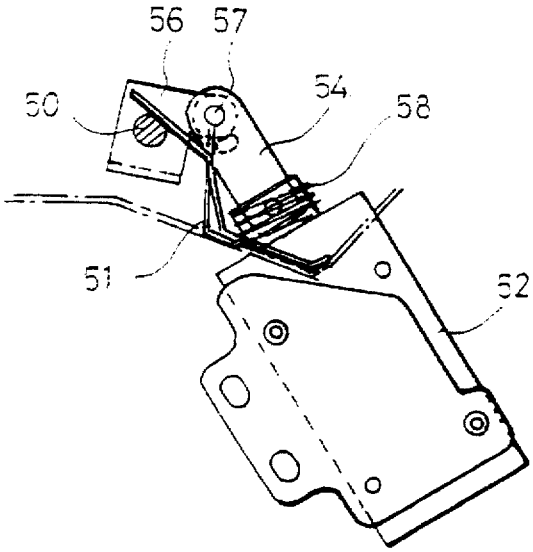

Referring to FIG. 4, in case that a sheet is fed to the outside of a cash dispenser, the solenoid 41 of the sheet feeding direction converting unit and the solenoid 52 of the sheet guiding unit maintained a turned off state. In the above-described state, a predetermined driving force is transferred from the step motor 21 to the rotary shaft 23 through the motor gear 34, the idler gear 35, and the connecting gear in order. The feeding roller 26 fixed to the rotary shaft 23 rotates, and at the same time the driving pulley 26 and the connecting pulley 31 each connected to the ends of the rotary shaft 23 rotate, so that the driving force is transferred to the following pulley 28 through the belt 30, and the feeding roller 25 rotates the rotary shaft 22. Thereafter, the driving force is transferred to the connecting pulley 32 through the belt 33, and the feeding roller 27 rotates the rotary shaft 24.

At this time, the rotary shafts 22, 23, and 24 rotate in a clockwise direction, thus feeding the sheet to the outside of the cash dispenser.

Thereafter, when a part of the sheet is exposed to the outside at the withdrawing port, the step motor 21 stops, and the feeding of the sheet stops. At this time, the sheet is located between the feeding roller 25 and the idler roller 62. The sheet withdrawing detection sensors 37 and 38 maintain turned-off state.

At this time, when a user takes out the sheet together with cash, in a state that the following pulley 28 is stopped, the feeding roller 25 on rotary shaft 22 and the idler roller 62 rotate to stably withdraw the sheet to the outside of the dispenser.

When the withdrawing operation is completed, the sheet withdrawing detection sensors 37 and 38 are turned on and the apparatus becomes ready for the next operation.

Meanwhile, in case that the user does not take out the sheet within a predetermined time, for example, 10 seconds, the sheet feeding-back operation is performed to feed back the sheet and to store it in the sheet storing box.

That is, in a state that a part of the sheet is exposed to the outside, after a predetermined time is lapsed, the solenoid 41 of the sheet feeding direction converting unit is turned on by the sheet withdrawing detection sensors 37 and 38. In addition, the plunger 41*a* is drawn in beyond the elastic force of the tension spring 47 and is received inside the solenoid 41. Thereafter, upon retraction of the plunger 41*a* and the link 43, the central shaft 39 and to the link 45 rotate in a counterclockwise direction, thus protruding the sheet feeding direction converting member 40 through the upper sheet guide 13, whereby the feeding direction of the sheet is changed to the lower direction. Thereafter, the step motor 31 reversely rotates, and the rotary shafts 22, 23, and 24 rotate in a counterclockwise direction, and the feeding rollers 25, 26, and 27 fixed to the rotary shafts 22, 23, and 24 rotate in a counterclockwise direction, whereby the feeding-back of the sheet can be achieved in accurately.

As described above, when the sheet passes through the feeding-back detection sensors 48 and 49, the step motor 21 reversely rotates until the sheet becomes idle from the feeding rollers 26 and 63, and the solenoid 52 of the sheet storing unit is driven.

Figure 9:
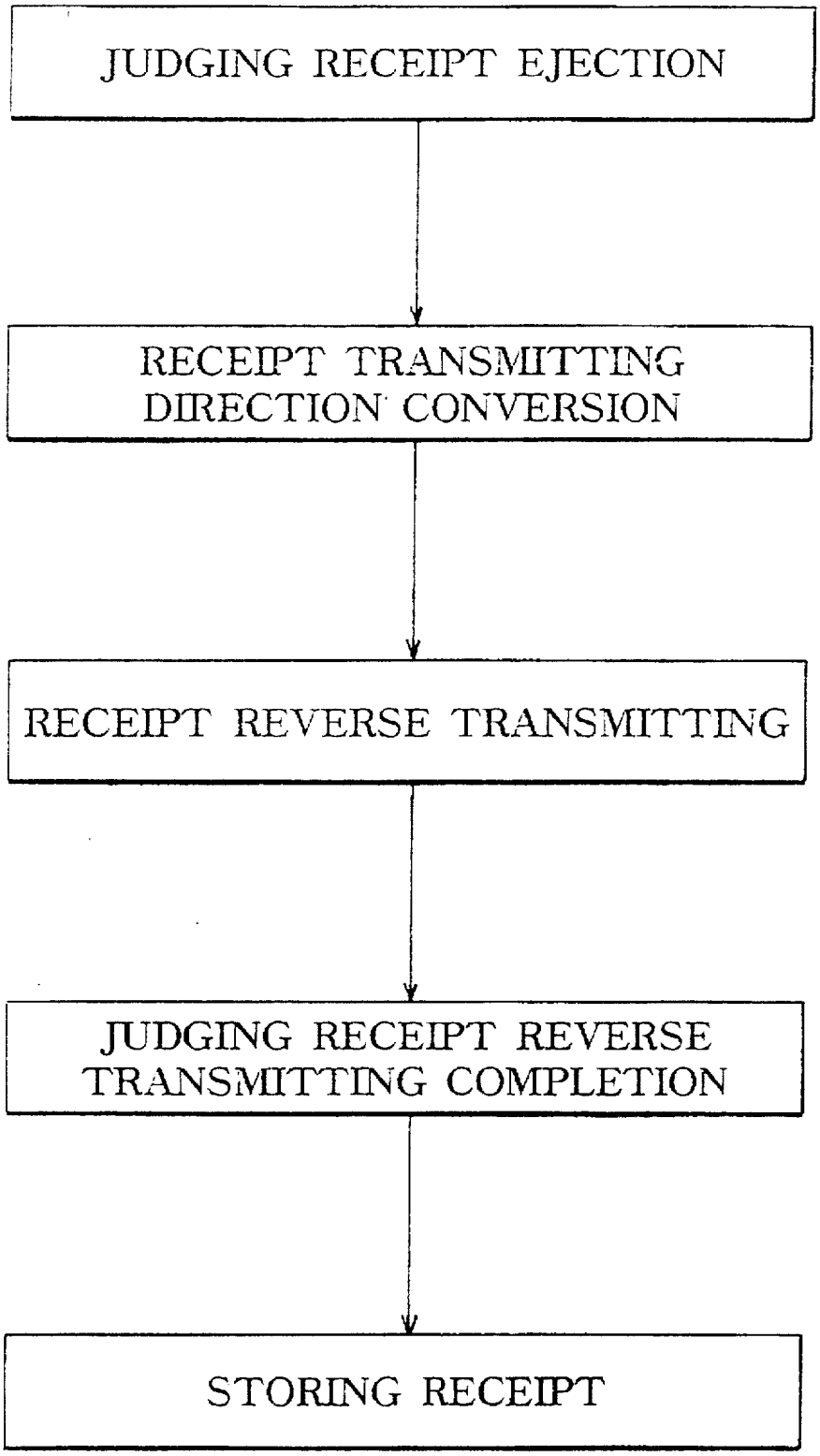
FIG. 9 is a flow chart of a sheet feeding method according to the present invention.

Therefore, the solenoid is turned on, and the plunger 52*a* is drawn in beyond the elastic force of the tension spring 58 as shown in FIGS. 9A and 9B, and is received in the solenoid 41, and upon retraction of the plunger 52*a*, the link 54, and the central shaft 50 connected to the link 56 rotate in a clockwise direction, and the pushing plate 51 guides the sheet into the sheet storing box 15.

Thereafter, the feeding-back detection sensors 48 and 49 are turned on, and the feeding-back operation of the sheet is completed.

As described above, the present invention is directed to providing a sheet feeding apparatus and a method thereof capable of preventing a jamming and skewing, thus achieving more stable operation of the machine.

What is claimed is:

1. A sheet feeding apparatus, comprising:

driving means for providing driving force;

sheet feeding means for feeding a sheet forwardly toward a withdrawing port and feeding back a sheet rearwardly away from the withdrawing port toward a sheet storing box and driven by said driving means;

sheet withdrawing detection means for detecting whether a sheet fed forward by the sheet feeding means has been withdrawn from the withdrawing port;

sheet feeding direction converting means disposed between front guide rollers and rear guide rollers and movable between a first position and second position for converting a feeding direction of a sheet being fed back;

sheet feeding-back completion detecting means for detecting the completion of the guiding of a sheet being fed back into the sheet storing box; and sheet storing means for storing a fed back sheet into a sheet storing box.

2. The sheet feeding apparatus of claim 1, wherein said apparatus further comprises sheet guiding means for guiding a sheet being fed back into the sheet storing box.

3. The sheet feeding apparatus of claim 1, wherein said apparatus further comprises sheet supporting means for stably supporting and guiding the sheet.

4. The apparatus of claim 3, wherein said sheet supporting means includes:

a fixing plate fixed to a predetermined portion of the brackets;

a supporting shaft fixed to both ends of said fixing plate; and an idle roller engaged to both ends of said supporting shaft and coming into contact with the feeding rollers.

5. The apparatus of claim 1, wherein said sheet feeding means includes:

a plurality of spaced-apart rotary shafts rotatably disposed at a pair of brackets;

a feeding roller fixed to both ends of one of said rotary shafts;

a plurality of driving pulleys and following pulleys engaged to one end of one of said rotary shafts;

a first belt for connecting said driving pulleys and said following pulleys;

a connecting pulley fixed to the other end of one of the rotary shafts; and a second belt for connecting said connecting pulley.

6. The apparatus of claim 1, wherein said sheet withdrawing detection means is a withdrawing detection sensor fixed to one end of an upper, lower sheet guide.

7. The apparatus of claim 1, wherein said sheet feeding direction converting means includes:

a central shaft rotatably disposed between a pair of brackets;

a plurality of spaced-apart feeding direction converting members fixed to a central portion of said central shaft; and means for rotating the central shaft to dispose the feeding direction converting member in a path of a sheet being fed back.

8. The apparatus of claim 7, wherein said sheet feeding direction converting means further includes:

a solenoid disposed at a fixing plate fixed to one end of the bracket;

a first link connected to a plunger of said solenoid by a pin;

a second fin fixed to one end of the central shaft, wherein said first link and second link are connected by a connecting pin to be eccentrical about a central axis thereof; and a tension spring connected to a fixing section of said connecting pin and said fixing plate, so that said solenoid drives the central shaft connected to the feeding direction converting member.

9. The apparatus of claim 1, wherein said sheet feeding-back completion detection means is a withdrawing detection sensor disposed at the front portion of the sheet feeding direction converting means.

10. The apparatus of claim 1, wherein said sheet feeding means includes:

a central shaft rotatably disposed at a predetermined portion of the central shaft;

a pushing plate fixed to an intermediate portion of the central shaft; and a solenoid for rotating the central shaft in a predetermined direction.

11. The apparatus of claim 10, wherein said sheet feeding means further includes:

a solenoid fixed to a fixing plate fixed to the bracket;

a third link connected to a plunger of the solenoid by a pin;

a fourth link connected to one end of the central shaft, so that said third link and said fourth link are connected to each other to be eccentrical about a central axis thereof; and a tension spring inserted into the plunger, wherein the solenoid drives the central shaft fixed to the pushing plate.

12. A sheet feeding method, comprising the steps of:

a first step which judges as to whether or not a sheet is fed back;

a second step which converts a sheet feeding direction;

a third step which feeds back the sheet;

a fourth step which judges as to whether or not a sheet feeding-back is completed; and a fifth step which stores a sheet into a sheet storing box.

13. The sheet feeding method of claim 12, wherein said method further comprises a sixth step which guides the sheets being stored into a sheet storing box.

* * * * *